United States Patent [19]

Horton et al.

[11] 3,952,120

[45] Apr. 20, 1976

[54] ALUMINUM-ZINC COATED LOW-ALLOY FERROUS PRODUCT AND METHOD

[75] Inventors: James B. Horton, Bethlehem; Angelo R. Borzillo, Norristown, both of Pa.

[73] Assignee: Bethlehem Steel Corporation, Bethlehem, Pa.

[22] Filed: May 31, 1974

[21] Appl. No.: 475,075

[52] U.S. Cl. ..... 427/433; 29/196.5; 75/146; 75/178 A

[51] Int. Cl.[2] ..... C22C 21/10; C23C 1/02

[58] Field of Search ..... 117/114 R, 114 A, 114 C; 29/196.2, 196.5; 75/178.6, 146; 427/433

[56] References Cited

UNITED STATES PATENTS

| | | | |
|---|---|---|---|
| 2,870,008 | 1/1959 | Neu | 75/146 |
| 3,343,930 | 9/1967 | Borzillo et al. | 117/114 A |
| 3,782,909 | 1/1974 | Cleary et al. | 117/114 A |

FOREIGN PATENTS OR APPLICATIONS

| | | |
|---|---|---|
| 771,501 | 4/1957 | United Kingdom |
| 707,035 | 7/1931 | France |
| 876,032 | 8/1961 | United Kingdom |

OTHER PUBLICATIONS

"The Formation of Aluminum Coatings in an Aluminum Bath," Stahl & Eisen 77, p. 436 (1957).

*Galvanizing*, by Bablik, 1950, pp. 204–223.

*Primary Examiner*—Mayer Weinblatt
*Assistant Examiner*—Edith R. Buffalow
*Attorney, Agent, or Firm*—Joseph J. O'Keefe; Charles A. Wilkinson

[57] ABSTRACT

Large steel products such as structural sections, castings, forgings and machined sections are coated with a smooth, adherent, bright metallic coating comprised of 25 to 85% aluminum, silicon in an amount of 0.7% or more by weight of the amount of aluminum and the balance substantially zinc without the occurrence of detrimental exothermic reactions of the coating medium with the base metal.

5 Claims, 1 Drawing Figure

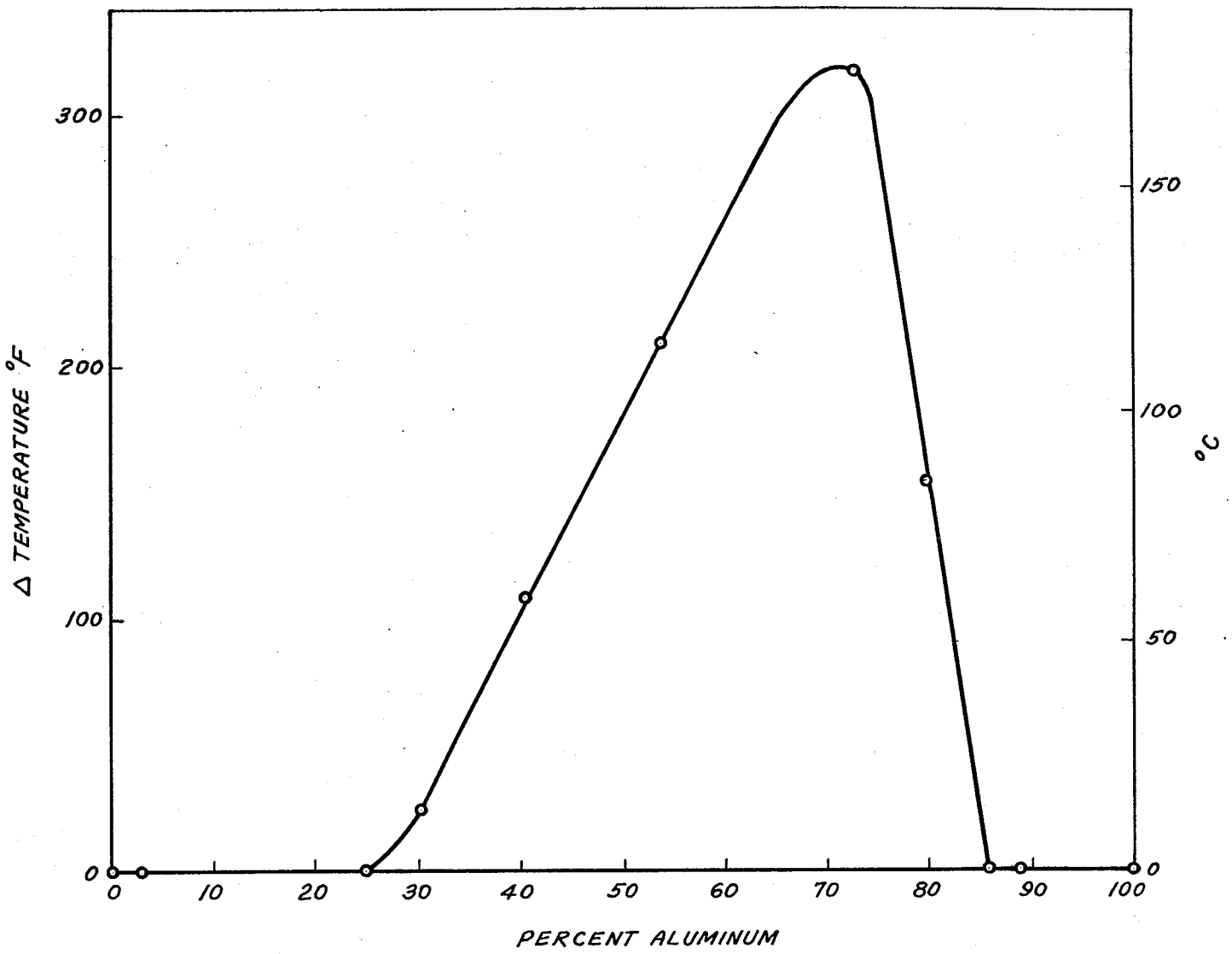
300
200
100
0
Δ TEMPERATURE °F
150
100
50
0
°C
0
10
20
30
40
50
60
70
80
90
100
PERCENT ALUMINUM

ALUMINUM-ZINC COATED LOW-ALLOY FERROUS PRODUCT AND METHOD

BACKGROUND OF THE INVENTION

This invention relates to the coating of steel substrates with metallic coatings and more particularly to the coating of steel products having substantial cross sectional areas with aluminum-zinc coatings.

Aluminum-zinc coatings and the products of such coatings have been disclosed and claimed in U.S. Pat. Nos. 3,343,930 and 3,393,089 issued to the present applicants in 1967 and 1968 repsectively. While the coatings disclosed in these prior patents were known to have very desirable corrosion properties it has since been determined by long term corrosion tests that the corrosion properties of the coatings are even more desirable than had at first been suspected. It has also been discovered that the optimum commercial corrosion properties of such coatings occur in a range centering rather closely about 55% aluminum and 45% zinc, at least for linear type relatively thin ferrous materials such as sheet, strip and wire products. Such products, which can be defined as bendable or inherently formable linear products require, when made by a hot dipping process, as taught previously by the prior patents, at least 0.5% silicon in the molten coating bath in order to attain a ductile adherent coating on the linear product. Bendable or inherently formable sections are customarily less than a quarter of an inch in thickness.

It has been discovered, however, that when aluminum-zinc type coatings are applied to more massive low alloy ferrous type products such as structural sections, plate, bars, castings, forgings and machined shapes and the like, where the dipping time is normally somewhat extended and the freezing time usually extended by the reduced rate of cooling of the more massive cross section of the product, that the intermetallic alloy layer between the outer coating and the underlying steel substrate tends to excessive growth. While the coatings desired on structural sections and the like are frequently thicker than the coatings desired for sheet and strip and the like, it is undesirable for such heavier coatings to be composed entirely of an alloy containing significant percentages of iron if the coating is to be smooth, adherent and have a bright metallic lustre. If the intermetallic layer thickens or grows to the extent that portions of the intermetallic layer extend to the surface of the overlying aluminum-zinc coating the smoothness and bright metallic lustre of the coating will be destroyed because of the uneven dull nature of the intermetallic layer. It has, therefore, been discovered that when coating massive steel sections with aluminum-zinc coatings that in order to obtain a smooth coating with a bright metallic lustre the amount of silicon present in the molten coating bath must be greater than the minimum necessary for the coating of linear products such as sheet, strip and wire.

It has also been discovered that for some purposes it may be advantageous to use even larger amounts of aluminum in the coating than the maximum set for the most desirable corrosion, i.e., not more than 70% aluminum as taught in applicants' prior patents. For more massive structural sections and the like it may be quite satisfactory to use more aluminum in the coating and at the same time have a thicker coating, as is usual in any event in structural sections, in order to make up for the loss in corrosion resistance. This is particularly true as the price of zinc becomes relatively greater than the price of aluminum on the world market and the use of relatively larger percentages of aluminum in the coating becomes more economically desirable. It has also been determined, however, that the very vigorous exothermic reaction which is characteristic of the application of aluminum-zinc coatings to steel and other high ferrous substrates reaches a maximum at about 70% zinc and then declines rapidly and dies out at about 85% aluminum. It has been discovered that this exothermic reaction, the vigorousness of which can be measured roughly by the elevation of the temperature of a sample above the temperature of a coating bath in which a sample has been immersed after the sample is removed from the bath, begins at a percentage of aluminum in the molten bath of about 25%, rapidly rises to a maximum at about 70 to 80% aluminum content in the bath where the rise in temperature of the sample after removal from the bath is about 300° Fahrenheit and then drops precipitously back to a minimum at about 85% aluminum content.

This vigorous reaction of the substrate with the molten aluminum-zinc coating results, unless the proper precautions are taken, in excessive growth of alloy layer on such heavy sections. In addition if high aluminum content aluminum-zinc coating baths are used, for example, in the range of 70 to 85% or so aluminum, the vigorous reaction of the substrate with the bath may result in the production of an excessive growth of alloy layer with resulting poor adhesion and ductility as well as a lack of a smooth and bright coating.

SUMMARY OF THE INVENTION

The foregoing difficulties and problems associated with the prior art methods of producing aluminum-zinc coated materials have now been obviated by operation in accordance with the present invention. The present inventors have discovered that smooth, adherent, bright metallic aluminum-zinc coatings can be obtained upon ferrous metallic bases from hot dip coating baths containing between 25 and 85% aluminum if silicon is provided in the molten bath in an amount equal to at least 0.7% by weight of the aluminum content of the bath. By operation in this manner the usual vigorous exothermic reaction of the bath containing between 25 and 85% aluminum is completely eliminated and excessive growth of an intermetallic alloy layer is prevented. By prevention of excessive reaction of the bath with the base metal so that no excessive heat is evolved between the cited composition ranges, and the resultant inhibition of excessive intermetallic alloy growth, the intermetallic layer is prevented from expanding until some or all of its upper surface reaches the surface of the metallic coating where the intermetallic layer would interfere with the smoothness of the coating and the bright metallic lustre of the coating. By limiting the thickness of the intermetallic layer the adherence of the coating also tends to be increased since an excessively thick intermetallic alloy layer tends to develop internal stresses in the layer which cause flaking and exfoliation of the entire coating.

BRIEF DESCRIPTION OF THE DRAWING

The single FIGURE is a graph plotting the elevation in temperature of a series of samples of a stantard mass and weight when dipped into a molten aluminum-zinc bath containing various percentages of aluminum. The elevation of the sample temperature is the elevation over the bath temperature.

DESCRIPTION OF THE PREFERRED EMBODIMENT

In accordance with the present invention structural sections may be coated in a hot metal bath by the usual batch type or even continuous structural dipping apparatus. The structural or other massive sections such as plate, bars, castings, forgings, machined shapes or the like are first cleaned in any suitable manner, heated to an elevated range of about 800° to 1000° Fahrenheit and then by means of suitable transporting and immersion apparatus dipped for at least 20 seconds and preferably for from 30 to 120 seconds or, less preferably, up to as much as 5 minutes or more into a large ceramic pot holding a bath of molten aluminum-zinc alloy. The alloy will contain from 25 to 85% aluminum, an amount of silicon equal to not less than 0.7% by weight of the aluminum content of the bath and the remainder of the molten bath will be comprised of zinc plus minor amounts of various contaminating materials including some iron usually dissolved from previous dipping operations in the molten bath.

After remaining in the molten bath or being otherwise exposed to the molten coating material for a short period, typically about 40 seconds or more, the section to be coated is removed from the coating bath or other coating means and the coating allowed to solidify in the air. The resulting coating will be found to have a coating typically of one or two mils thickness and an alloy layer of no more than about 1 to 1½ mils thickness. More typically the intermetallic alloy layer will be about ½ mil in thickness or occassionally from ¼ to 1 or 1½ mils. The intermetallic alloy layer will thus not extend to the surface of the coating and the coating will be found to have a smooth coating having the characteristic bright, frosty white metallic sheen typical of aluminum-zinc coatings. The coating will also be found to be adherent to the base metal with no tendency to spontaneous spalling or flaking off the base metal.

The intermetallic layer will in all cases be of no more than intermediate thickness with respect to the coating no matter what the aluminum percentage in the coating is. By intermediate thickness is meant that the intermetallic layer is significantly less thick than the overall metallic coating and has a substantially smooth upper surface no substantial portion of which, excluding localized projections, extends to or through the coating surface to disturb the smoothness or brightness of the outer surface of the coating.

The FIGURE consists of a curve which depicts the elevation in temperature of a series of standard thin section samples dipped into a molten aluminum-zinc bath and withdrawn while the temperature is monitored by means of a thermocouple welded to the surface. The molten bath contained no silicon. The ordinate represents the maximum elevation in temperature reached by the sample above the temperature of the molten bath after withdrawal from the molten bath due to the continuing vigorous exothermic reaction of the molten coating metal with the underlying ferrous substrate. The abscissa records the percentage of aluminum in the molten bath. The elevation of the temperature recorded is the absolute elevation over the temperature of the molten coating bath and thus the base line for the higher aluminum percentages in the bath will, of course, be relatively higher. The approximate temperatures for molten aluminum-zinc baths of various percentages are shown below:

| Al percent | Approximate bath Temperature Degrees Fahrenheit |
|---|---|
| 25 | 1000 |
| 30 | 1040 |
| 41 | 1100 |
| 54 | 1130 |
| 65 | 1180 |
| 73 | 1200 |
| 80 | 1220 |
| 86 | 1240 |
| 89 | 1245 |

The elevation of the temperature of the sample is a reliable indication of the vigorousness of the reaction of the molten bath material with the underlying ferrous substrate and the degree of difficulty which is likely to be encountered in controlling the reaction. As will be seen the applicants have determined that the percentage of aluminum in the molten baths which will experience a vigorous exothermic reaction with ferrous substrate metal are from 25 to 85% aluminum. The vigorousness of the reaction is also a general indication of the amount of excessive growth of the intermetallic alloy layer which may be expected to occur. It should be understood, however, that a thin intermetallic alloy layer will still be obtained beyond the limits specified and, furthermore, that once the area of vigorous exothermic reaction is reached the intermetallic alloy layer will almost immediately become too heavy to be satisfactory without deliberate inhibition by the addition of silicon to the bath metal. The height of the curve in the FIGURE thus is an indication of degrees of unsatisfactoriness of the thickness of the expected intermetallic alloy layer rather than an indication of satisfactory and unsatisfactory alloy layers. The area of satisfactory intermetallic alloy layer is the areas from zero to 25% aluminum where no exothermic reaction will be detected with standard samples and the similar area from about 85 to 100% aluminum is the area in which the intermetallic alloy layer will be found to be satisfactory and the coating smooth, bright and adherent. It is only from 25 to 85% aluminum that the intermetallic alloy layer will be found to be undesirably thick on structural and other massive sections due to the vigorous and completely unexpected exothermic reaction of the ferrous base metal with the molten coating. The best corrosion properties will be found in coatings having from 45 to 65% aluminum contents by weight, but coatings having from 25 to 45% aluminum and from 65 to 85% aluminum will also be found to have desirable properties. Some of the higher aluminum coatings in particular have very attractive properties from an economic standpoint in times of severe price elevation in the world market price of zinc. It is in exactly these ranges of aluminum-zinc coatings where the most difficulty with excessive intermetallic alloy growth and exothermic reaction tend to occur.

Surprisingly the vigorous exothermic reaction of aluminum-zinc coating baths having an aluminum content of from 25 to 85% does not appear to take place with other substrate metals. For example, the applicants have coated stainless steel, tantalum, titanium, chromized steel (i.e. steel with a chromium powder sintered and fused to the surface), nickel and cobalt in a molten aluminum-zinc bath containing 55% aluminum and no inhibiting silicon without any apparent initiation of an exothermic reaction.

As an example of their invention the applicants may take a large structural section comprising an I-beam section formed from 1020 grade steel and dip it into a molten aluminum-zinc bath containing 55% aluminum, an amount of silicon equal to 1% of the amount of the aluminum and the balance substantially zinc. The molten bath is held at approximately 1130° F. and the section held in the bath for 45 seconds. The section is then removed and the coating allowed to solidify in the ambient air. The final coating will be found to be adherent, smooth and have the characteristic bright frosty white metallic luster of aluminum-zinc coatings. Examination of a cross section of the coating will reveal an intermediate thickness of intermetallic alloy layer approximately 1 mil thick in a 2 mil coating.

We claim:

1. An improved method of applying an aluminum-zinc coating from a hot-dip bath to a ferrous substrate which substrate is:

a. at least ¼ inch in thickness, b. low in alloy content, c. a manufactured product from the groups consisting of structural sections, plates, bars, castings, forgings and machined shapes, to form a smooth bright aluminum-zinc coating at least 1 to 2 mils in thickness having an iron containing intermetallic alloy layer between the substrate metal and the outer aluminum-zinc coating, said alloy layer having:

i. a thickness of between ¼ mil and 1½ mils and being of no more than about intermediate thickness with respect to the coating as a whole, and ii. having a substantially smooth upper surface no substantial portion of which, excluding localized projections, extends to the surface of the coating to disturb the smoothness and brightness of the outer surface of the coating, comprising:

A. cleaning the ferrous substrate and heating to at least 800° F.,

B. immersing said ferrous substrate in a molten aluminum-zinc bath comprised of 25 to 85% by weight aluminum, silicon in an amount not less than 0.7% by weight of the aluminum content, the balance substantially zinc, C. allowing said ferrous substrate to remain in said bath in contact with the molten aluminum-zinc in said bath for a period of from 20 seconds to 5 minutes, and D. withdrawing said ferrous substrate from the molten aluminum-zinc bath to permit solidification of an aluminum-zinc coating having a smooth, bright, adherent coating.

2. An improved method according to claim 1 in which the ferrous substrate is allowed to remain in said molten bath for from 30 to 120 seconds.

3. An improved method according to claim 2 in which the aluminum content of the molten bath is from 45 to 65%.

4. A method according to claim 1 wherein the molten coating bath contains 70 to 85% aluminum.

5. An improved method according to claim 4 in which the ferrous substrate is allowed to remain in said molten bath for from 30 to 120 seconds.

* * * * *